US007731250B2

(12) United States Patent
Garneau et al.

(10) Patent No.: US 7,731,250 B2
(45) **Date of Patent: *Jun. 8, 2010**

(54) ELECTROMECHANICAL PUSH TO CLOSE LATCH

(75) Inventors: Gregory Gilbert Garneau, Berlin, NJ (US); Robert Benson Speers, West Chester, PA (US)

(73) Assignee: Southco, Inc., Concordville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/116,313

(22) Filed: May 7, 2008

(65) Prior Publication Data

US 2009/0001733 A1 Jan. 1, 2009

Related U.S. Application Data

(62) Division of application No. 11/383,582, filed on May 16, 2006, now Pat. No. 7,455,335.

(60) Provisional application No. 60/686,036, filed on May 29, 2005.

(51) Int. Cl.
*E05C 1/06* (2006.01)
*E05C 19/00* (2006.01)

(52) U.S. Cl. ..... 292/144; 292/279; 292/341.16; 292/DIG. 11; 49/280

(58) Field of Classification Search ..... 292/144, 292/244, 279, 341.16, DIG. 11; 49/280
See application file for complete search history.

(56) References Cited

U.S. PATENT DOCUMENTS 2,860,904 A 11/1958 Barry et al.
3,302,964 A 2/1967 Barry
3,947,060 A * 3/1976 Zimmer et al. ..... 292/142
3,966,152 A 6/1976 Bromberg
4,000,800 A 1/1977 Loucks, Sr.
4,170,374 A 10/1979 Garcia
4,472,846 A 9/1984 Volk, Jr. et al.
4,583,775 A 4/1986 Bisbing
4,667,990 A * 5/1987 Quantz ..... 292/201
4,707,007 A 11/1987 Inoh
4,833,465 A 5/1989 Abend et al.
4,854,618 A 8/1989 Webster
4,891,994 A 1/1990 Barba
4,911,487 A 3/1990 Rachocki
4,993,757 A 2/1991 Corzine
5,002,322 A * 3/1991 Fukumoto ..... 292/341.16
5,037,145 A 8/1991 Wilkes (Continued)

FOREIGN PATENT DOCUMENTS

DE 3507349 3/1985

(Continued)

*Primary Examiner*—Carlos Lugo
(74) *Attorney, Agent, or Firm*—Paul & Paul

(57) ABSTRACT

An electromechanical push to close latch has a pawl positioned for linear movement in a housing, with the pawl being biased to the outward extended position. An electric motor operates a cam to change the position of the pawl thereby retracting it into the housing. An electronic circuit board controls the operation of the electric motor under the direction of an outside control signal. The circuit board also senses the position of the pawl to stop the operation of the motor when the pawl is fully retracted. The pawl mounting can be reconfigured for the pawl to extend and thereby operate in a plurality of selectable directions.

14 Claims, 14 Drawing Sheets

U.S. PATENT DOCUMENTS

| | | | | | |
|---|---|---|---|---|---|
| 5,044,678 | A | * | 9/1991 | Detweiler | 292/144 |
| 5,083,448 | A | | 1/1992 | Karkkainen et al. | |
| 5,222,774 | A | * | 6/1993 | Fukumoto et al. | 292/144 |
| 5,249,831 | A | * | 10/1993 | Maniaci | 292/144 |
| 5,328,218 | A | | 7/1994 | Brusasco et al. | |
| 5,404,737 | A | * | 4/1995 | Hotzl | 70/279.1 |
| 5,473,922 | A | * | 12/1995 | Bair et al. | 70/416 |
| 5,480,198 | A | * | 1/1996 | Wydler et al. | 292/144 |
| 5,586,458 | A | | 12/1996 | Weinerman et al. | |
| 5,597,188 | A | | 1/1997 | Miche | |
| 5,611,224 | A | | 3/1997 | Weinerman et al. | |
| 5,791,179 | A | * | 8/1998 | Brask | 70/278.1 |
| 5,862,692 | A | | 1/1999 | Legault et al. | |
| 5,862,693 | A | * | 1/1999 | Myers et al. | 70/278.1 |
| 5,938,254 | A | * | 8/1999 | Weyerstall | 292/341.16 |
| 5,997,054 | A | | 12/1999 | Baudu et al. | |
| 6,012,310 | A | * | 1/2000 | Hsiao | 70/278.2 |
| 6,112,563 | A | * | 9/2000 | Ramos | 70/278.1 |
| 6,135,514 | A | | 10/2000 | Kowalewski et al. | |
| 6,314,773 | B1 | * | 11/2001 | Miller et al. | 70/303 A |
| 6,381,999 | B1 | * | 5/2002 | Doong | 70/107 |
| 6,496,101 | B1 | | 12/2002 | Stillwagon | |
| 6,502,438 | B1 | * | 1/2003 | Miller et al. | 70/303 A |
| 6,502,903 | B2 | | 1/2003 | Bruck et al. | |
| 6,546,769 | B2 | * | 4/2003 | Miller et al. | 70/303 A |
| 6,575,504 | B2 | | 6/2003 | Roatis et al. | |
| 6,641,182 | B2 | | 11/2003 | Schlack et al. | |
| 6,813,917 | B2 | | 11/2004 | Miller et al. | |
| 6,848,729 | B2 | | 2/2005 | Caspi et al. | |
| 6,902,214 | B2 | | 6/2005 | Smith | |
| 7,073,827 | B2 | | 7/2006 | Cherry | |
| 7,131,673 | B2 | * | 11/2006 | Cherry et al. | 292/341.16 |
| 7,192,066 | B2 | | 3/2007 | Ilea et al. | |
| 7,341,292 | B2 | * | 3/2008 | Brose et al. | 292/341.15 |
| 7,455,335 | B2 | * | 11/2008 | Garneau et al. | 292/144 |
| 2003/0084616 | A1 | | 5/2003 | Kimball | |
| 2003/0193199 | A1 | | 10/2003 | Talukdar et al. | |
| 2003/0227181 | A1 | | 12/2003 | Cherry et al. | |
| 2004/0169378 | A1 | | 9/2004 | Hodgin et al. | |
| 2006/0267349 | A1 | * | 11/2006 | Garneau et al. | 292/144 |
| 2009/0058102 | A1 | * | 3/2009 | Garneau et al. | 292/163 |

FOREIGN PATENT DOCUMENTS

| | | | |
|---|---|---|---|
| DE | 3507349 | A1 | 9/1986 |
| DE | 3700891 | | 1/1987 |
| DE | 3806422 | | 2/1988 |
| DE | 39 28 580 | A1 | 4/1990 |
| DE | 298 03 845 | U1 | 3/1998 |
| DE | 299 23 398 | U1 | 5/1999 |
| DE | 10246644 | A1 | 4/2004 |
| EP | 0034129 | A1 | 8/1981 |
| EP | 0537531 | A1 | 4/1993 |
| GB | 2445135 | A | 6/2008 |

* cited by examiner

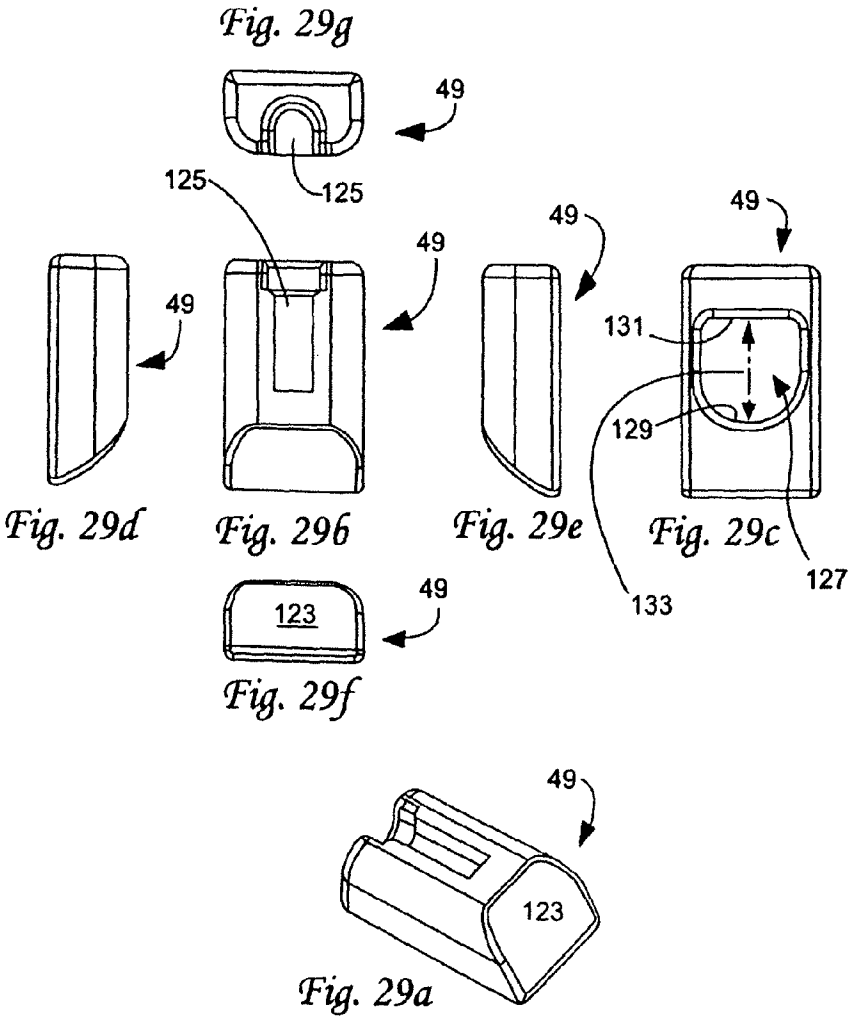
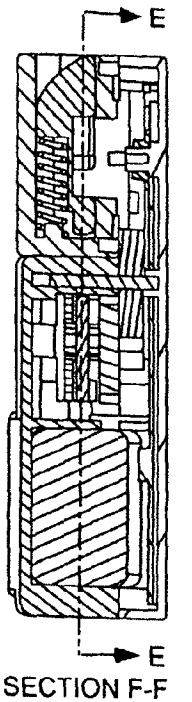
Fig. 20a
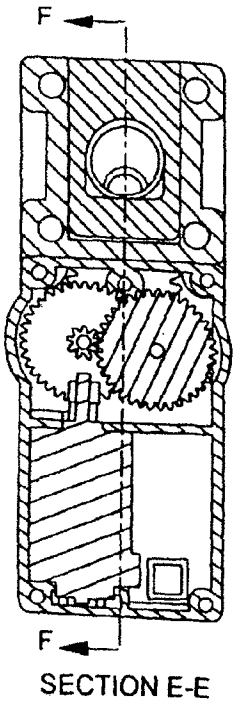
Fig. 20

ELECTROMECHANICAL PUSH TO CLOSE LATCH

RELATED APPLICATIONS

This is a divisional application of pending U.S. patent application Ser. No. 11/383,582, filed May 16, 2006, for an electromechanical push to close latch, and incorporates by reference the entirety of that application. This application claims priority of U.S. provisional application 60/686,036, filed May 29, 2005, for electromechanical push to close latch, and incorporates by reference the disclosure of that application.

BACKGROUND OF THE INVENTION

The present invention is directed to push to close latches, and specifically a release mechanism for opening the push to close latch.

Push to close latches typically, have a tapered, ramp-ended, blade-shaped pawls or bar-shaped pawls. These pawls are spring-biased to the latched/closed position, wherein the pawl extends outwardly from the latch housing. As the pawl of a push to close latch encounters the striker, the ramping force pushes the pawl inward against the spring force until the pawl clears the striker, wherein after the spring then forces the pawl to its extended position and the latch becomes latched.

A lock plug with a pivoting blade striker can be incorporated to provide both the striker and a key lock function, wherein the push to close latch is in a separate housing. When a passive striker is used, a retraction knob may be incorporated into the pawl housing to retract the pawl against its outwardly biasing spring. A lock plug can be used instead of the retraction knob, wherein as the key turns the plug a linkage retracts the pawl into the housing.

Alternately, paddles have been used instead of knobs or lock plugs to activate the pawl to retract it against the force of its biasing spring and into the housing.

With the advent of more security systems, it has become desirable to utilize push to close latches, which are thereby locked when latched. With such security push to close latches it has also become desirable to active, i.e., to operate the latch remotely. Such remotely operated, push to close latches are electrically operated, and therefore are electromechanical devices. The remote activation can be by the operation of an electric signal button operated by a guard or a security officer, or by an electric signal button operated by a resident of an apartment in an apartment building, or by a signal generated by a code entry pad or swipe card reader. The electric signal causes the pawl to be retracted so that the door may be opened.

Typically, the activation device at the latch is an electromagnet or a solenoid. When the electric current flows, the pawl is retracted into the housing and the door can open. When the electric current stops the biasing spring forces the pawl to the extended position.

These electrically operated, prior electromechanical push to close latches have developed problems because of wear and erratic operation, and because of the timing and length of the electric activation signal when the button operator is out of sight of the door and the latch being operated. As an example, if the door is pulled prior to the pawl being retracted, the pawl can bind and the solenoid activator is unable to retract the pawl. Various installations limit the size of the latch housing and therefore the capacity and strength of electromagnetic activator or the solenoid.

What is desired is a latch which is smoothly operating and which has a controlled operation for pawl movement.

What is further desired is a latch which is easily reconfigured for a plurality of different installations.

SUMMARY OF THE INVENTION

An object of the present invention is to provide an electromechanical push to close latch which is remotely operated under the direction of an input control signal. The latch has a spring loaded (biased) linear retracting pawl. When not being commanded to retract, the pawl is spring biased to its normally extended position. From the extended position, the pawl is free to retract, into a housing, when sufficient force is applied to overcome the spring biasing. The pawl, which is blade or bar shaped, has a tapered or ramped end, which acts against a striker to move the pawl against the spring force. Thus the latch is used as a push to close latch.

An electric DC motor is coupled through a gearbox to rotate a cam which is connected to retract the pawl into the pawl housing when a control signal is sent to the motor. The pawl can be maintained in the retracted position without power being further applied to the motor, when the motor is stopped as the pawl is sensed to be in the appropriate position.

This push to close latch may be operated against various keepers to provide for different latching functionality. When operated against a fixed keeper or enclosure undercut, a simple mechanical push to close and thereby "latch" function is implemented. When operated against a rotateable flange on a lock plug, the mechanical override function of the key lock is provided.

The latch has a multi-sectional housing which contains the motor, a circuit board connected to control the motor operation and to sense the pawl position, a gear box which couples the motor to a cam, and a cam which is mounted to move the pawl in a linear motion. The pawl and its biasing spring are mounted in a separable housing section. The pawl housing can be mounted with the pawl extending and operating in any of three directions with respect to the motor and gearbox portion of the housing. These three positions have the pawl extending longitudinally from an end of the housing, or transversely to the right or to the left.

The output gear of the gearbox has associated with it a ribbed or toothed hub. The cam snaps onto that hub and is driven, i.e., rotated. The cam engages an opening or pocket in the pawl. When the output gear rotates, the hub rotates the cam to drive the pawl in a reciprocating linear motion. When the pawl housing orientation is changed from longitudinal to transversely to the right or to the left, the cam is removed from the hub and reoriented consistent with the reorientation of the pawl.

A small electric DC motor provides the power to operate the latch. The gearbox provides a gear reduction system to reduce the rotational speed of the motor from about 8000 rpm to about 60 rpm and multiplies the torque available from the motor to operate the latch. An electronic circuit board monitors the position of the output gear and thereby the position of the cam, and ultimately the position of the pawl. This circuit board provides power to the motor which controls the pawl position, i.e., the status of the latch.

The circuit board also includes a dual position sensor to provide a feedback signal to a controller circuit to confirm one or two positions of the latch. The latch has two operating positions, these being the pawl fully extended position and the pawl fully retracted position. The two positions are defined and sensed by two different size holes in the output gear. Two sensors on the circuit boar monitor for the presence of a hole and determine if it is the larger hole or the smaller hole. One of the sensors is used as an endpoint sensor to stop the motor in either position. The other sensor is used as a position sensor to detect if the gear and thereby the pawl is in position "1" or "2". The position sensor will only detect the larger of the two holes and thus can distinguish between position 1 and 2. With the output gear in position 1, the pawl is and/or can be fully extended under the force of its biasing spring, and only the endpoint sensor is detecting a hole (the small hole). With the output gear in position 2, the pawl is in the retracted position and both the endpoint sensor and the position sensor are detecting a hole (the larger hole).

When a signal is received for the latch to change positions, the electrical circuits are delayed to initially ignore a start hole and after the short delay period begin to sense for the new end point and position.

The sensing circuit may be altered to provide the same functions. As an example, there need be only one hole in the output spur gear and the sensors can be positioned 180 degrees apart. The present design uses infrared light and infrared sensors. Alternatively, Hall-effect sensors can be used, or other types of sensors suitable to the size and power application. If position feedback is not required, only one position sensor need be used.

The gearbox output spur gear and the cam are two separate parts that are configured in different keyed positions to one another as a function of the pawl housing orientation. When for size considerations, it is desirable to have the output gear and cam as one molded integrated part, three different output gears would be needed for the change over between different pawl housing orientations.

The concept of this invention of a gear driven, cam operated, push to close pawl latch is equally applicable to smaller sized latches which require less power and larger sized latches which require more power.

The layout of the gearbox relative to the cam/pawl can be altered to accommodate different mounting and space constraints. The number of gears in the gearbox will depend upon the motor selected, the motor speed, and the torque increase needed to successfully control the pawl position under actual operating conditions and wear In some instances, it could be desirable to have a non-reconfigureable pawl housing.

BRIEF DESCRIPTION OF THE DRAWINGS

The features, advantage and operation of the present invention will become readily apparent and further understood from a reading of the following detailed description with the accompanying drawings, in which like numerals refer to like elements, and in which:

FIG. 20 is a top orientation sectional view of the latch, with the pawl retracted by the motor, gear and cam drive, taken as shown in FIG. 20*a;*

FIG. 20*a* is a right orientation sectional view taken as shown in FIG. 20;

FIGS. 29*a*-29*g* are perspective, top, bottom, right side, left side, ramp end, and opposite end views, respectively, of the pawl of FIG. 7;

DETAILED DESCRIPTION OF THE INVENTION

The present invention is an electromechanical, gear driven, cam operated, push to close pawl latch, having a pawl housing portion which is reconfigurable with respect to the main portion of the housing for selectively changing pawl orientation. A DC electric motor drives the gears under the control of a circuit board which includes pawl/cam position sensors and provides a feedback signal to a motor controller circuit on the board. The motor controller circuit is implemented with a microprocessor circuit which is capable of controlling the motor for selectively positioning a pawl drive cam in either of two positions, which thereby selectively permits the pawl to be retracted or released to extend under a spring biasing force. The spring force is insufficient to overcome the inertial of the motor and gears, so that the pawl may remain retracted with no power to the motor. The microprocessor receives input signals through a circuit board connector.

Figure 1:
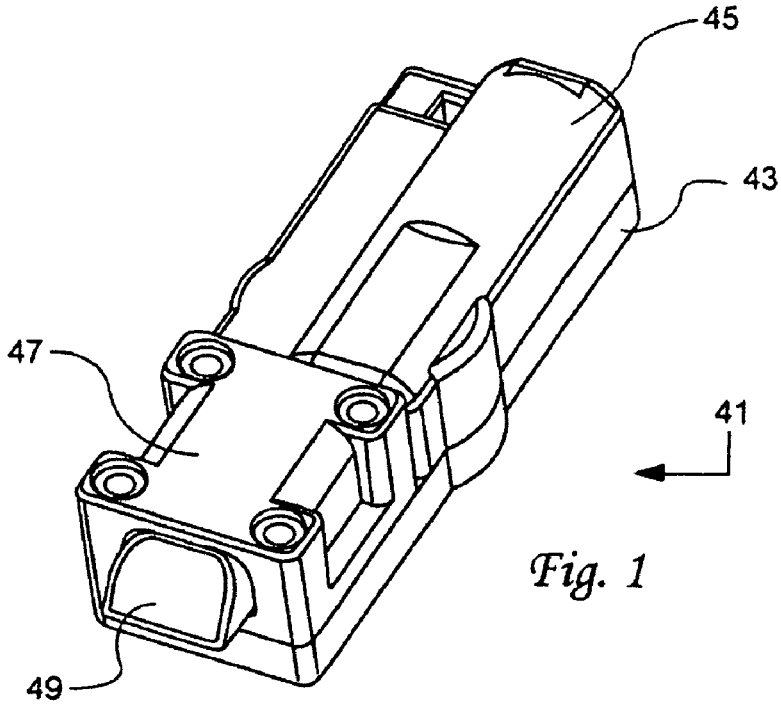
FIG. 1 is a perspective view of the electromechanical push to close latch.

The push to close latch 41, FIG. 1, has a three part housing, with a base 43, a motor and gearbox encasement 45, and a pawl housing 47. A pawl 49 operates linearly in the pawl housing 47.

Figure 2:
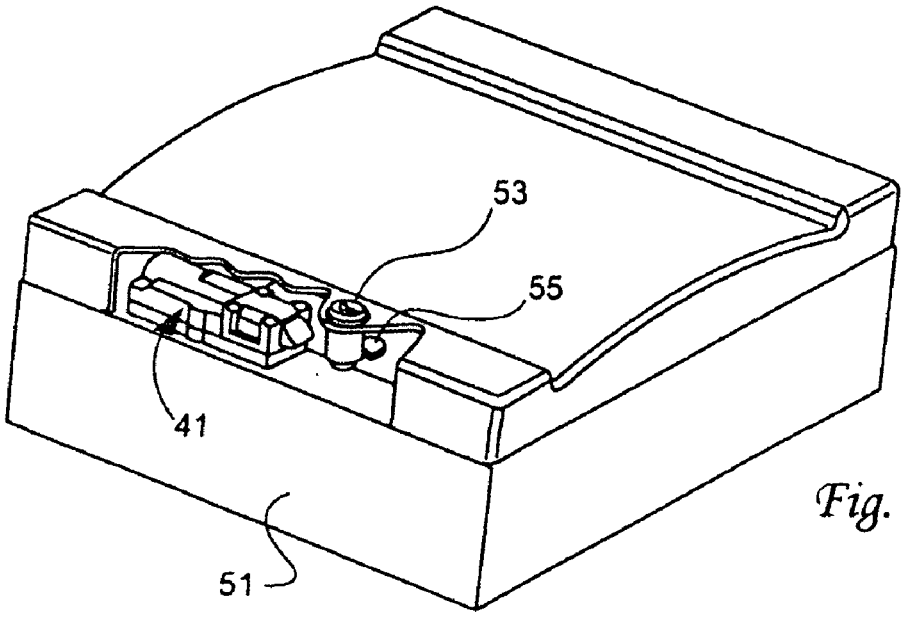
FIG. 2 is a partial cut-away, perspective view of the latch of the invention in a cabinet having a lock plug rotatable blade keeper rotated to the open/unlocked position.

The latch 41 can be installed on cabinets, entrance doors or cases. In FIG. 2, it is installed on a cabinet 51 wall and functions in combination with a lock plug 53 having a blade-type striker plate 55.

Figure 3:
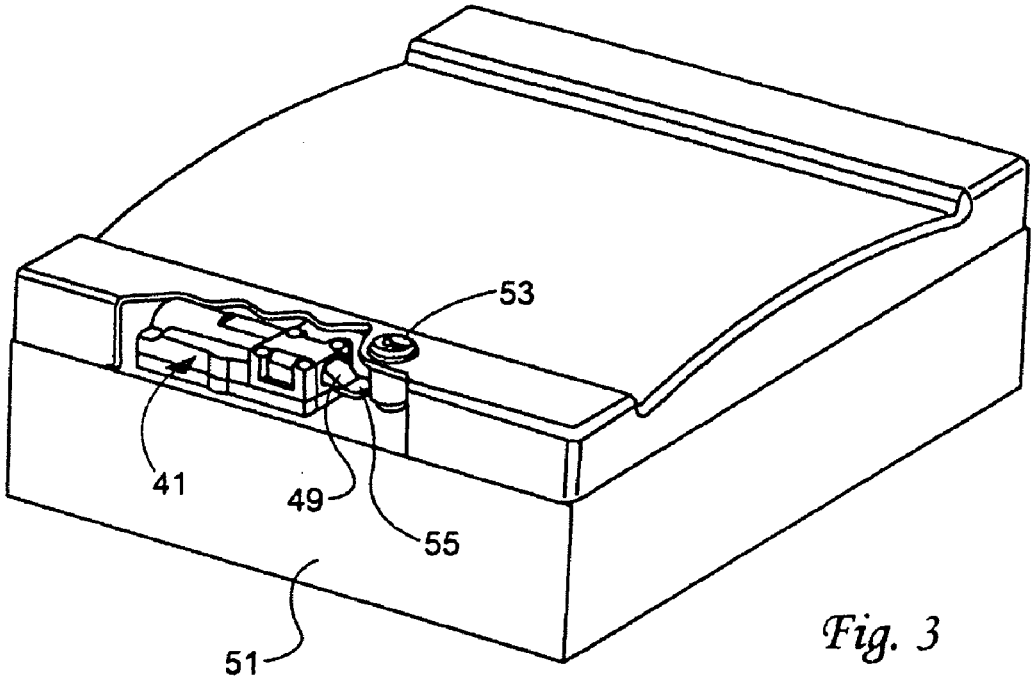
FIG. 3 is a partial cut-away, perspective view of the latch and the cabinet of FIG. 2, where the pawl of the latch is engaged with the keeper to lock the cabinet.
Figure 4:
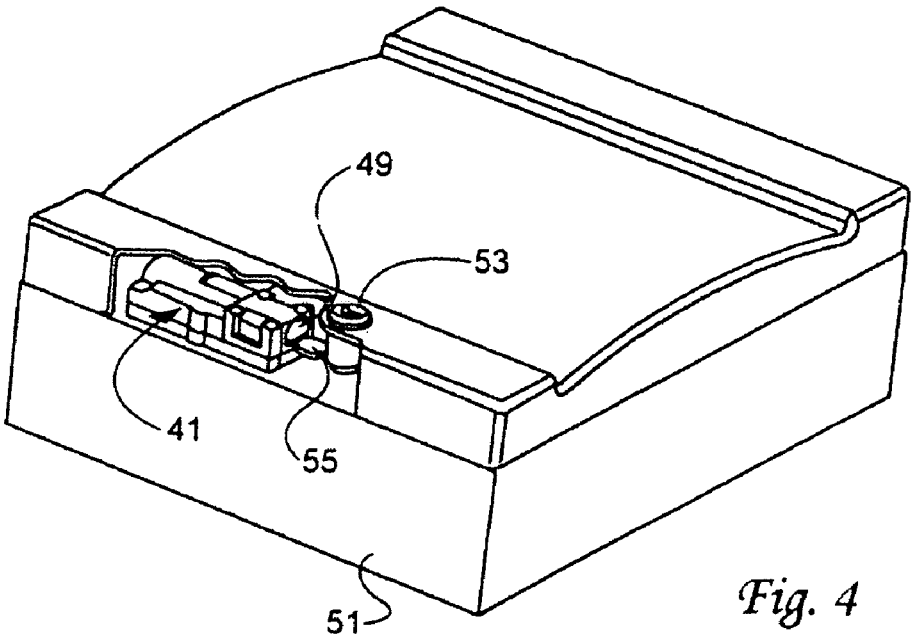
FIG. 4 is a partial cut-away, perspective view of the latch and the cabinet of FIG. 2, with the pawl retracted so that the cabinet door is free to open.

With the pawl is freed, FIG. 3, it is free to operate as the pawl in a traditional push to close latch with the pawl 49 engaging the striker blade 55 under the force of its biasing spring. When the input signal to the microprocessor causes a control signal to operate the motor, the pawl 49 is retracted from the lock plug striker blade 55, FIG. 4, even when the key of the lock plug 53 is not operated.

Figure 5:
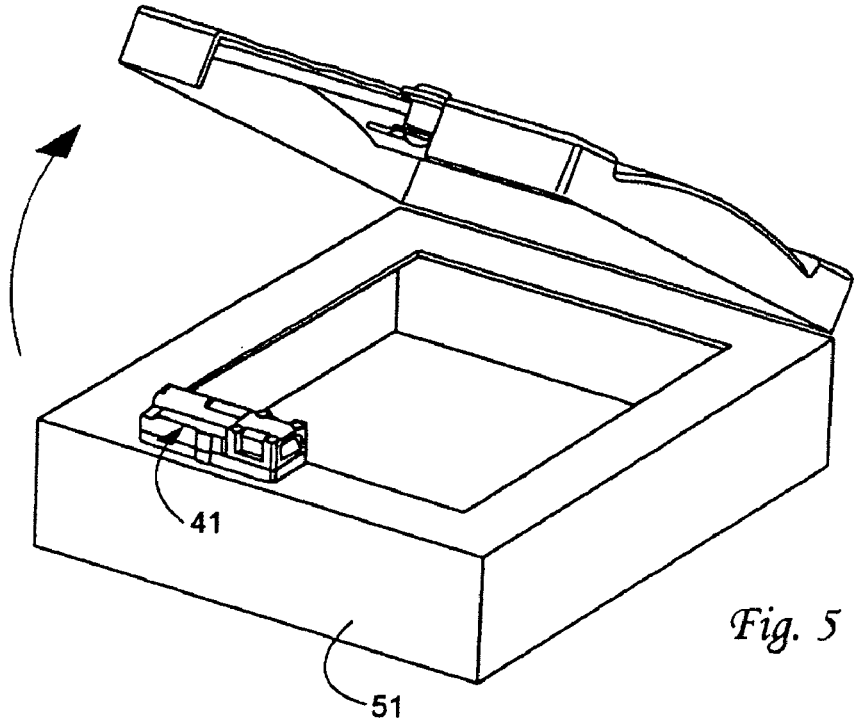
FIG. 5 is a partial cut-away, perspective view of the latch and the cabinet of FIG. 2, with the latch pawl remaining in the retracted position and the cabinet door open.
Figure 6:
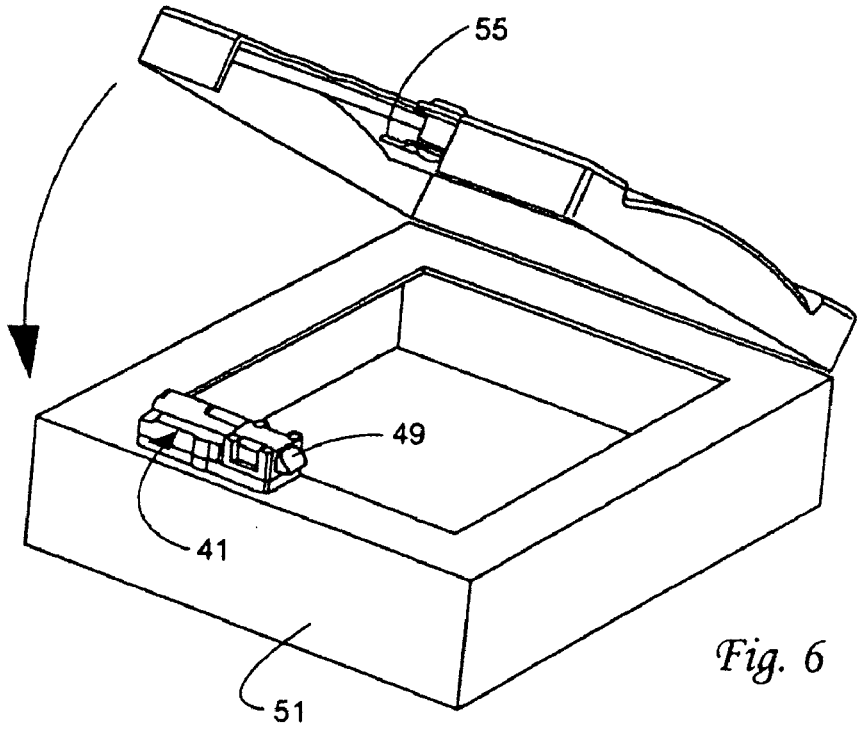
FIG. 6 is a partial cut-away, perspective view of the latch and the cabinet of FIG. 2, with the pawl released and extended under its spring biased force and the cabinet door ready to close the keeper against the latch pawl.

With the pawl electromechanically retracted, the door of the cabinet is free to open, FIG. 5. When the door of the cabinet 51 is closed, with the striker blade interrupting the ramp end of the pawl 49, the latch locks as a push to close latch, FIG. 6.

Figure 7:
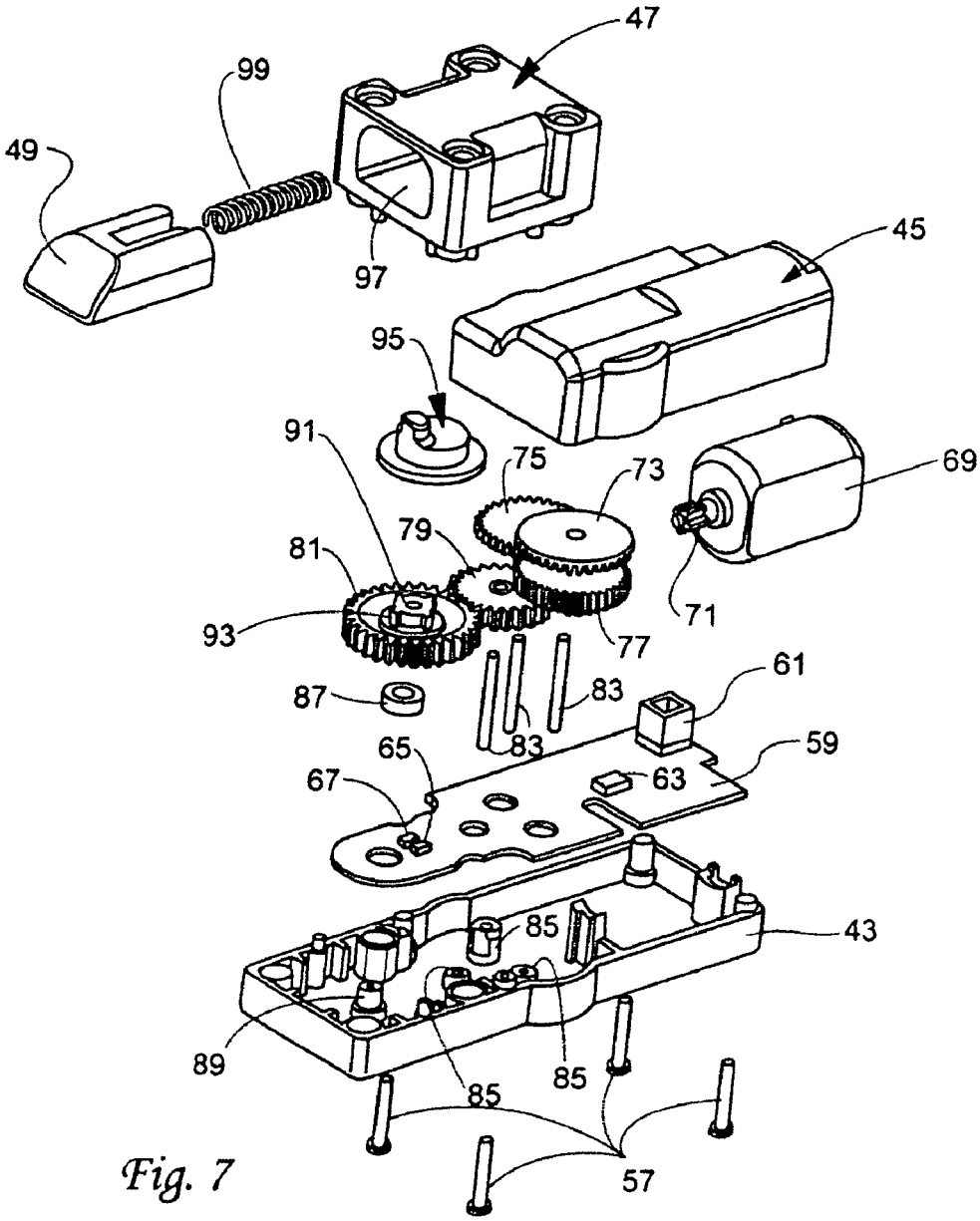
FIG. 7 is an exploded perspective view of the electromechanical latch of the present invention.

The latch 41 is shown in an exploded view in FIG. 7. The housing base 43 is a molded structure, with a series of journals, pass-through openings and stand off structures. The motor and gearbox encasement 45 is held to the housing base 43 with a plurality of at least four screws 57. The circuit board 59 is shaped to seat down into the housing base 43. Carried on the circuit board is a connector 61, a microprocessor chip 63, and a pair of infrared sensors 65, 67.

A small DC electric motor 69 mounts above the circuit board 59. This motor 69 is controlled to rotate in one direction by control signals from the microprocessor 63.

The output shaft of the motor 69 has a pinion gear 71 which engages a gearbox of 5 reduction gears, 73, 75, 77, 79, 81. The first four of these gears (73, 75,77, 79) are mounted on three gear spindles 83 which mount into individual bosses 85 in the housing base 45 and extend upwardly to the motor and gearbox encasement 45 which encases the motor 69, circuit board 59 and the first four gears 73, 75, 77, 79. The fourth gear 79 and the fifth gear 81 are mounted in the housing base 43 below the circuit board.

The fifth gear 81, being the output gear rides on a bushing 87 which mounts on a boss 89 in the housing base 43. The output gear 81 has a central upward projecting hub 91 with four quadrant vertically extending ribs 93. These ribs 93 extend radially outward from the center of the hub 91. This hub 91 can alternately carry a plurality of splines.

A cam 95 mounts on the hub 91 of the output gear 81 to engage a pocket in the paw 49. The pawl operates linearly in the interior 97 of the housing 47 and is biased to the extended outward position by a compression spring 99. The pawl housing is held to the housing base 43 with four screws (not shown). The motor gearbox encasement has four closed walls as the output gear 81 and the fourth gear 79 operate below the circuit board 59 and within the confines of the side walls of the housing base 43.

Figure 8:
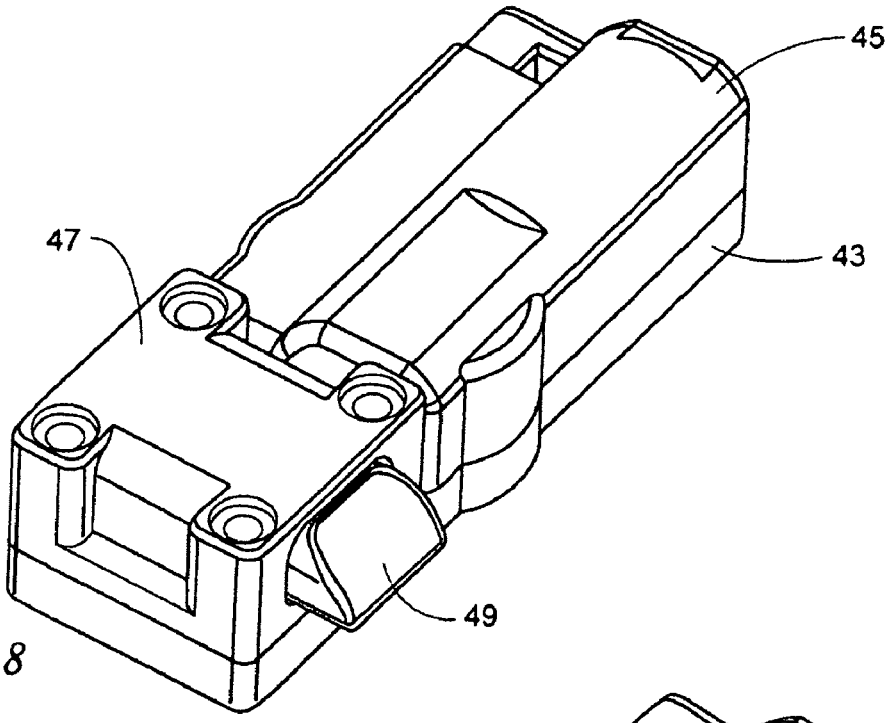
FIG. 8 is a perspective view of the latch of FIG. 1 with the pawl housing repositioned for left-hand operation.
Figure 9:
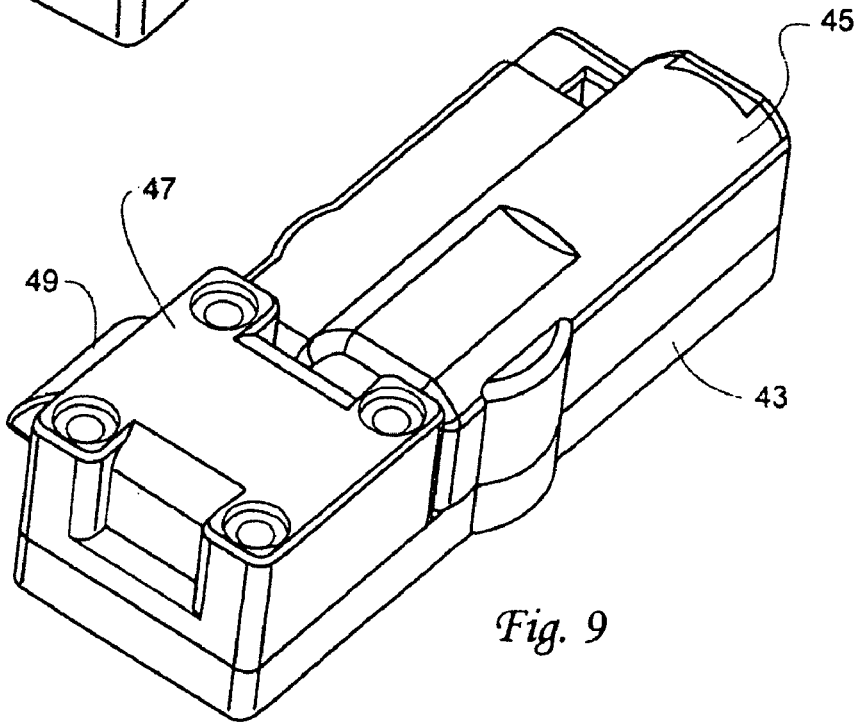
FIG. 9 is a perspective view of the latch of FIG. 1 with the pawl housing repositioned for right-hand operation.
Figure 10F:
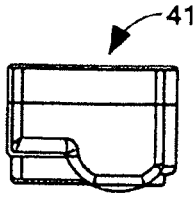
FIGS. 10*a*-10*f* are top, bottom, right side, left side, pawl end, and opposite end views, respectively, of the latch of FIG. 1.
Figure 10C:
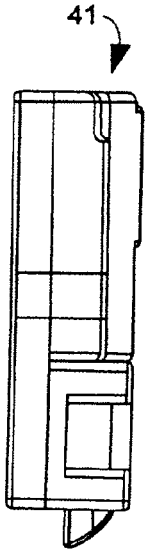
Figure 10A:
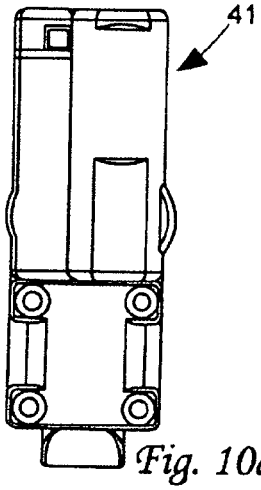
Figure 10D:
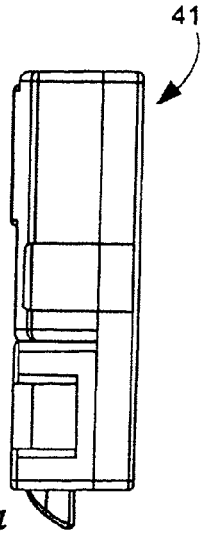
Figure 10B:
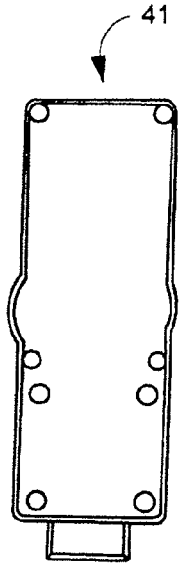
Figure 10E:
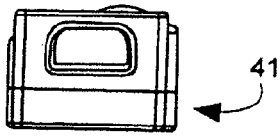

The pawl housing 47 and thereby the pawl 49 situated within said pawl housing 47, may be mounted on the housing base 43 in one of three positions as shown in FIGS. 8, 9, 10*a* for left hand operation, FIG. 8 with respect to the housing base 43, or for right hand operation FIG. 9 with respect to the housing base 43, or for outward end operation FIG. 10*a* with respect to the housing base 43. What is required to effect these conversions, is to remove and rotate (reposition) the pawl housing 47 and to remove and reorient (reposition) the cam 95 on the output gear 81.

Figure 12:
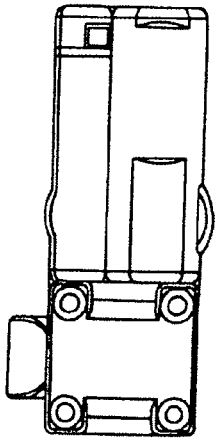
FIG. 12 is a top view of the right-hand pawl orientation for the latch of FIG. 9.
Figure 11:
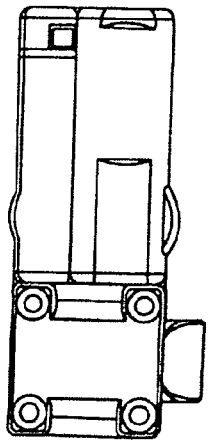
FIG. 11 is a top view of the left-hand pawl orientation for the latch of FIG. 8.

The external features of the latch 41 are readily seen from FIGS. 10*a*-10*f*. The reconfigured left hand operation pawl 45, and right hand operation pawl 45 where the pawl direction of operation is 180 degrees apart are shown in FIGS. 11 and 12 respectively. The outward end pawl direction of operation FIG. 10*a* is 90 degrees between the left and right hand directions of operation.

Figures 13, 14, 15:
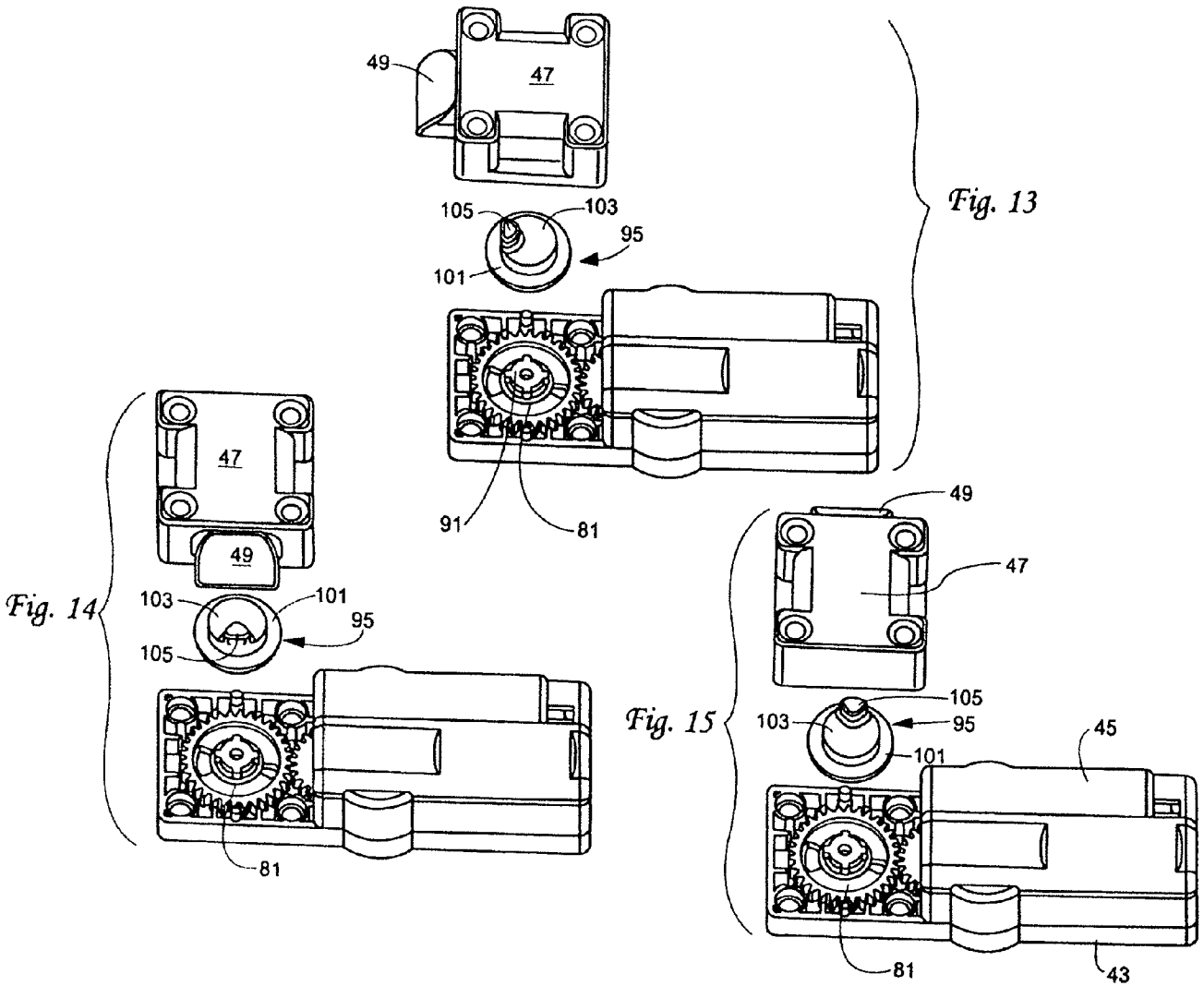
FIG. 13 is an exploded view of the pawl housing portion of the latch for a straight on longitudinal pawl operation.
FIG. 14 is an exploded view of the pawl housing portion of the latch for a left-hand operation/orientation.
FIG. 15 is an exploded view of the pawl housing portion of the latch for a right-hand operation/orientation.

As seen in FIG. 7, and in FIGS. 13-15, respectively, the cam 95 has a base flange 101, and upstanding hub 103 and a projecting cam finger or plug 105. FIGS. 13-15 each show an exploded view of the pawl housing 47, cam 95 and output gear 81. The cam 95 is mounted onto the output gear hub 91 with the cam plug 105 facing in the direction of the outward extension of the pawl 49.

Figure 16:
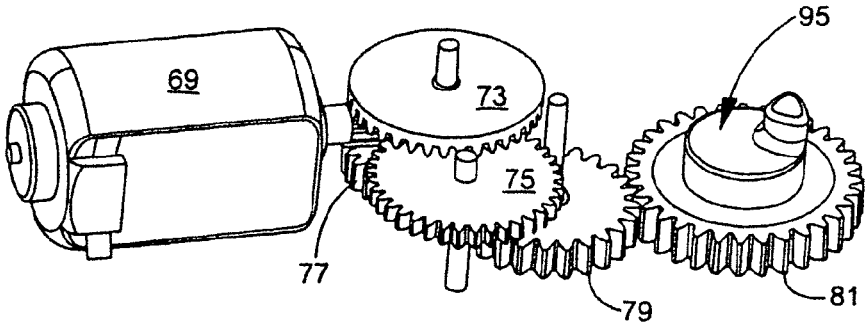
FIG. 16 is a right side view of the motor, gear and cam drive of FIG. 7.
Figure 17:
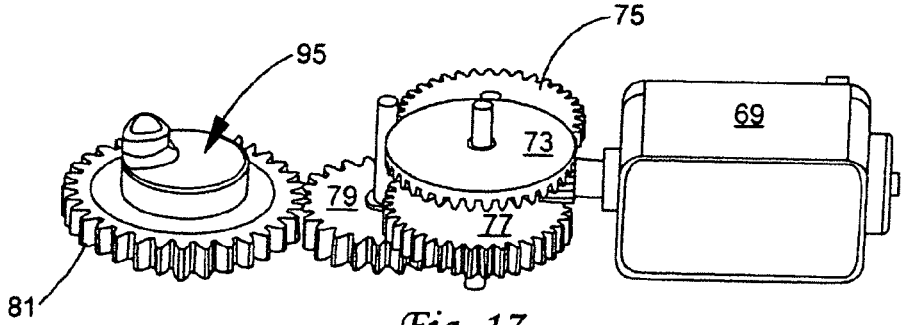
FIG. 17 is a left side view of the motor, gear and cam drive of FIG. 16.

FIGS. 16 and 17 show right side views and left side views of the motor and gearbox, respectively. The pinion gear 71 on the motor 69 shaft drives a crown gear 73 (the first gear), which carries a downward projecting pinion 107, FIG. 23*a*. This second pinion gear 107 being a part crown gear 73 engages the teeth of a spur gear 75 (the second gear) which also carries a downward facing pinion 109, FIG. 24*a*. The third pinion 109 being a part of the spur gear 75 engages the spur gear teeth of the spur gear 77 (the third gear). This third gear 77 also has a downward facing pinion 111, FIG. 25*a*. The fourth pinion 111 on the third gear 77 engages the spur gear teeth of a spur gear 79 (the fourth gear). The fourth gear 79 drives the output spur gear 81 (the fifth gear) carrying the cam 95.

Figure 23A:
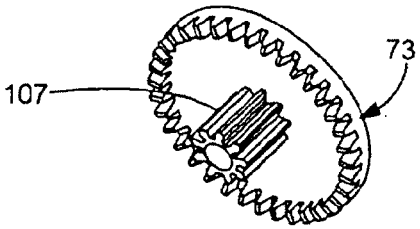
FIGS. 23*a*-23*c* are perspective, bottom, and side views, respectively, of the first gear.
Figure 23B:
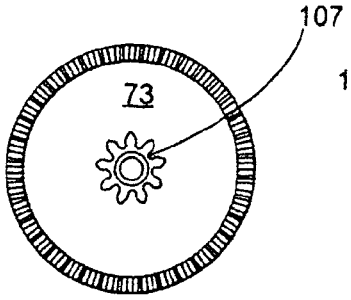
Figure 23C:
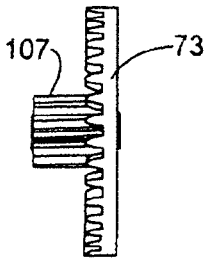
Figure 24A:
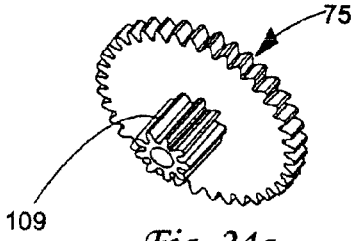
FIGS. 24*a*-24*c* are perspective, bottom, and top views, respectively, of the second gear.
Figure 24C:
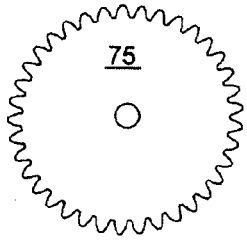
Figure 24B:
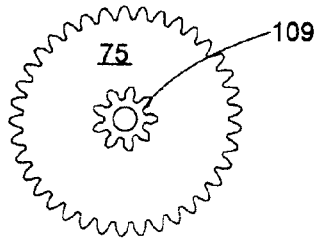
Figure 25A:
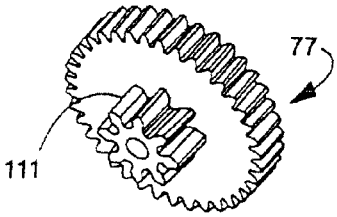
FIGS. 25*a*-25*c* are perspective, bottom, and top views, respectively, of the third gear.
Figure 25C:
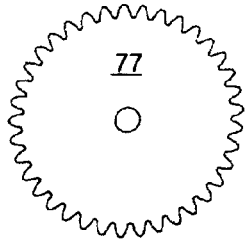
Figure 25B:
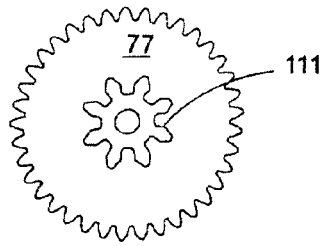
Figure 26A:
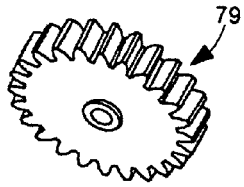
FIGS. 26*a*-26*c* are perspective, bottom, and top views, respectively, of the fourth gear.
Figure 26C:
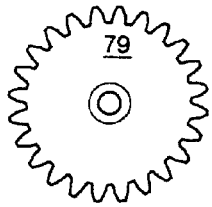
Figure 26B:
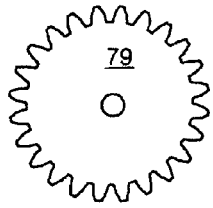

Various views of the first gear 73 are seen in FIGS. 23*a*-23*c*, while various views of the second gear 75 are seen in FIGS. 24*a*-24*c*. Several views of the third gear 77 are seen in FIGS. 26*a*-26*c*, while several views of the fourth gear 79 are seen in FIGS. 26*a*-26*c*.

Figure 27A:
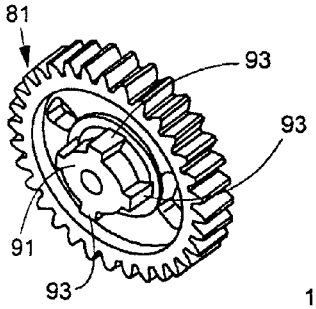
FIGS. 27*a*-27*c* are perspective, bottom, and top views, respectively, of the fifth gear.
Figure 27B:
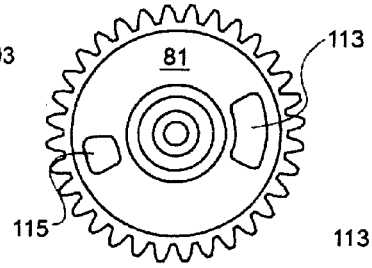
Figure 27C:
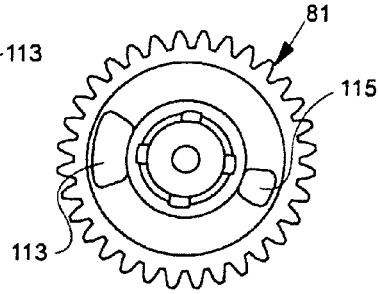

As seen in FIGS. 27*a*-27*c*, the perspective, bottom and top views of the output gear 81, the output gear 81 carries a larger, arc-like hole 113 and a smaller, arc-like hole 115, which is diametrically across from the larger hole 113.

Figure 28A:
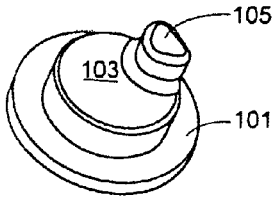
FIGS. 28*a*-28*c* are perspective, bottom, and tope views, respectively, of the cam of FIG. 7.
Figure 28B:
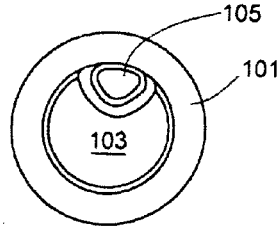
Figure 28C:
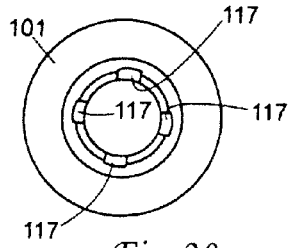

The flange 101 on the cam extends outwardly from the cam hub, FIGS. 28*a*-28*c*. This flange covers inner portion of the output gear 81 so that the infrared signals from the sensors 65 and 67 mounted on the circuit board 59 reflect off of the flange material and back to the sensors 65, 67. The interior of the cam hub 103 carries four quadrant slots 117 which fit the ribs 93 on the output gear hub 91 to lock the cam 95 onto the output gear 81.

The circuit board 59 is shaped to seat down within the side walls of the housing base 43 and carries various holes for the gear spindles 83, for the mounting bushing 87 for the output gear 81, and for the pinion 111 extending downward from the third gear 77.

Figure 31:
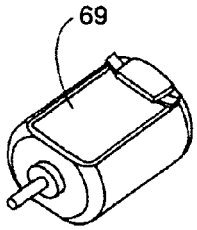
FIG. 31 is a perspective view of the motor of FIG. 7.
Figure 33:
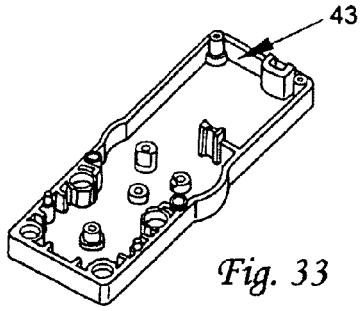
FIG. 33 is a perspective view of the inside of the housing bottom section.
Figure 32A:
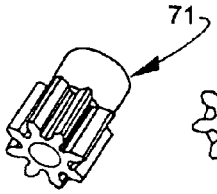
FIGS. 32*a*-32*c* are perspective, outside end, and inside end views, respectively, of the motor pinion gear.
Figure 32B:
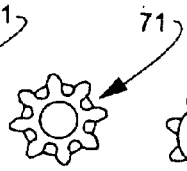
Figure 32C:
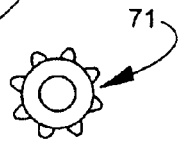
Figure 34:
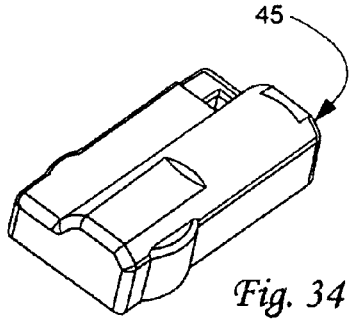
FIG. 34 is a perspective view of the outside of the housing top section which encases the motor and reduction first through fourth gears.
Figure 35:
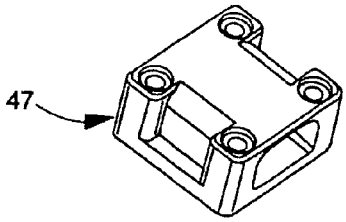
FIG. 35 is a perspective view of the outside of the pawl housing which encases the spring, output/fifth gear, cam, and pawl.
Figure 36B:
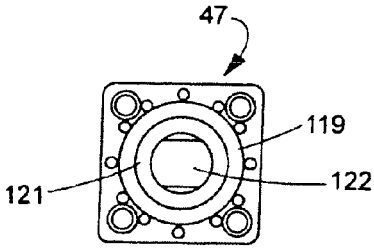
FIGS. 36*a*-36*c* are top, bottom and pawl opening side views, respectively, of the pawl housing.
Figure 36A:
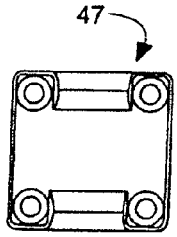
Figure 36C:
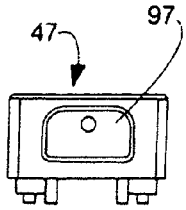

The motor 69 is shown in a perspective view in FIG. 31, and the housing base 43 is shown in a perspective view in FIG. 33. In FIGS. 32*a*-32*c* various views of the motor pinion gear 71 can be seen. The relationship between the motor gearbox encasement 43 and the pawl 47 is understood by from FIGS. 34 and 35. While the pawl housing is seen from the top, bottom and the pawl cavity 97 side in FIGS. 36*a*, 36*b*, and 36*c*, respectively. The pawl housing bottom, FIG. 36*b* has two step-out circular cavities 119, 121 (i.e., circular sockets to receive the cam thereinto), to accommodate the cam base flange 101 and upstanding hub 103, respectively. A concentric opening 122 permits an access for the cam plug 105 to extend into the pawl cavity 97 and engage the pawl 49.

The pawl 49 is seen in various views in FIGS. 29*a*-29*g*. The end of the pawl 49 has a ramped camming surface 123 which engages the striker 55. The top of the paw has an open channel 125 partially extending the length of the pawl 49, in which the compression spring 99 operates to bias the pawl 49 outwardly from the pawl housing 47. The bottom face of the pawl 49 has a cam cavity 127 having a curved wall 129 at the ramp 123 end of the pawl 49, and a straight wall 131 at the opposite end of the pawl 49.

Figure 19A:
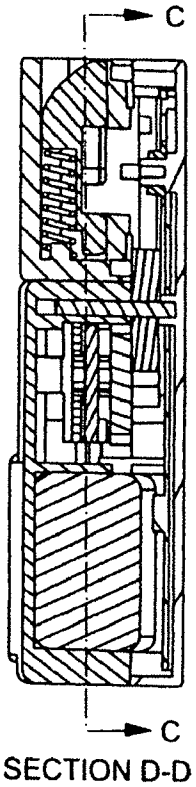
FIG. 19*a* is a right orientation sectional view taken as shown in FIG. 19.
Figure 19:
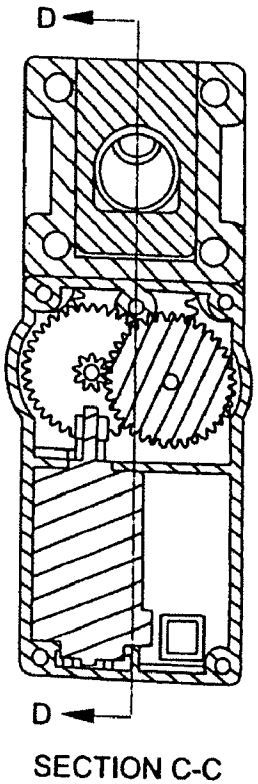
FIG. 19 is a top orientation sectional view of the latch, with the pawl retracted under striker pressure, taken as shown in FIG. 19*a;*
Figure 18A:
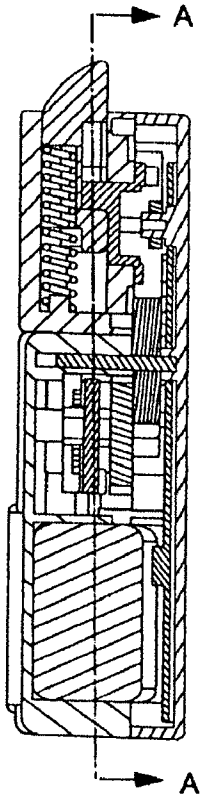
FIG. 18*a* is a right orientation sectional view taken as shown in FIG. 18.
Figure 18:
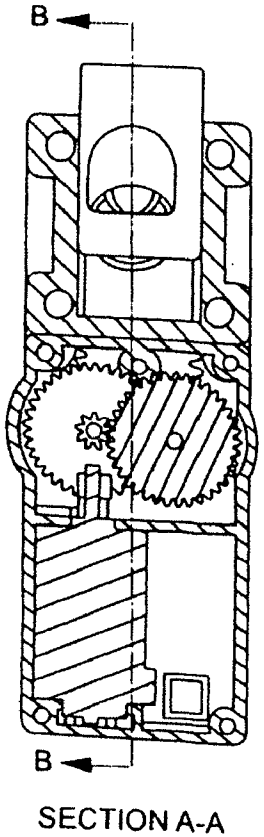
FIG. 18 is a top orientation sectional view of the latch, with the pawl released to extend under spring pressure, taken as shown in FIG. 18*a;*

FIGS. 18-22*a* show the position of the pawl and cam for various operating situations. In FIGS. 18 and 18*a*, the motor is off, the cam plug is in the outward facing position, and the pawl is free to move under the force of the biasing spring or a force against its ramp surface, as defined by the depth of the pawl cavity. These figures show the pawl in the extended position. FIGS. 19 and 19*a* have the latch components in the same position, but with the pawl in the fully retracted position. FIGS. 20 and 20*a* shown the pawl and came when the motor has rotated the cam to retract the pawl to the retracted position.

When the cam 95 is rotated, the cam plug 105 operates against the straight wall 131 of the cam cavity 127 to retract the pawl 49 into thee housing 47 against the spring force. The curved wall 129 provide a clearance for the cam plug 105 to rotate without operating against the pawl.

Figures 21, 21A, 22, 22A:
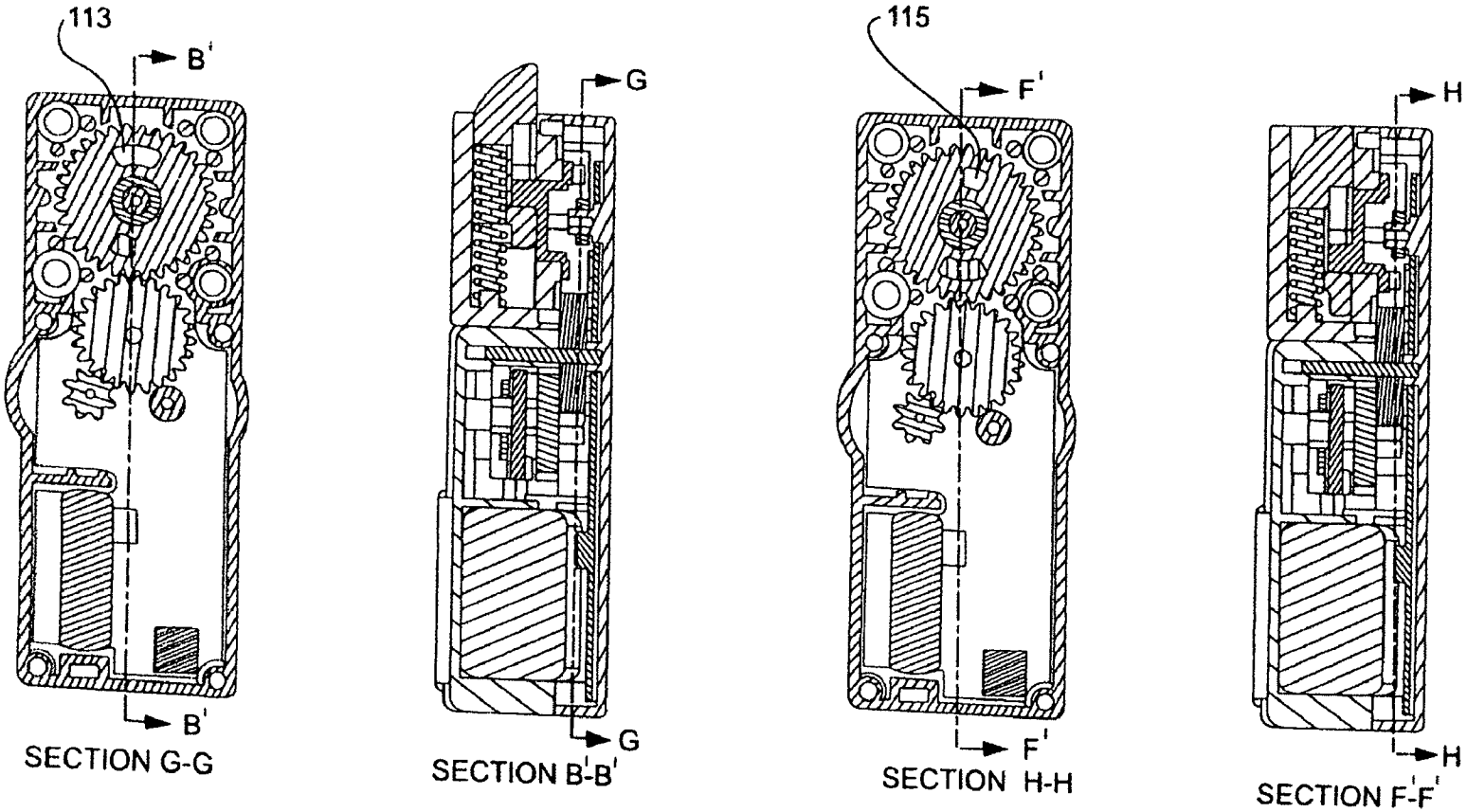
FIG. 21 is a bottom orientation sectional view of the latch taken as shown in FIG. 21*a*, wherein the latch is in the same position as seen in FIG. 18*a;*
FIG. 21*a* is a right side orientation sectional view taken as shown in FIG. 21.
FIG. 22 is a top orientation sectional view of the latch taken as shown in FIG. 22*a*, wherein the latch is in the same position as seen in FIG. 20*a;*
FIG. 22*a* is a right side orientation sectional view taken as shown in FIG. 22.
Figure 30A:
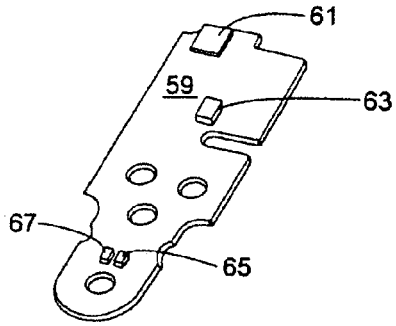
FIGS. 30*a*-30*c* are perspective, top and bottom views, respectively, of the circuit board of FIG. 7.
Figure 30C:
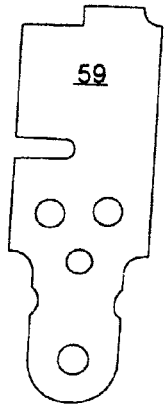
Figure 30B:
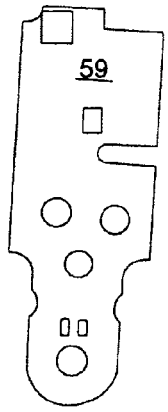

FIG. 21 shows the bottom of the gearbox when the pawl is in the free position and both of the two sensors 65, 67 sense the big hole 113. This is the situation where the cam plug is in the outward position to allow free movement of the pawl against its biasing spring and the ramp force against a striker.

FIG. 22 shows the bottom of the gear box when motor and gearbox dictated retracted position, whereby the cam plug is in the inward position. In this state, only one of the sensor 65, 67 is able to obtain a reading. The sensors sense the presence of the small hole 115 in this state.

When in operation, the microprocessor 63 receives an open command from the desperate signal device, such as the code entry pad, swipe card reader, a lock key plug. This signal enters the circuit board 59 at the connector 61. The microprocessor then controls the operation of the motor 69 to cause the cam to rotate 180 degrees to fully retract the pawl 49 into the housing 47. When the cam 95 reaches the 180 degree position, the sensors 65, 67 sense that position and feed a signal to the microprocessor which stops the rotation of the cam 95. After a predetermined period of time, e.g., a time sufficient for the cabinet 51 door to be opened, the microprocessor again causes the motor to operate to cause the cam to rotate 180 degrees to its initial position.

This is the cam inoperative position. When the cam is in this position, the latch can remain locked, if the door of the cabinet was not timely opened, or the latch is returned to a mechanically-operated push (slam) to close operation, under the influence of its biasing spring 99.

Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

What is claimed is:

1. An electromechanical latch having a pawl for engaging a striker, comprising:

a housing having a first and second portions;

wherein said pawl is mounted to and is operable within said second housing portion between a first latching and second unlatched positions, wherein said pawl is biased to said first position;

an electromotive assembly mounted in said first housing portion and including a motor operatively connected to a gear having a mounting surface;

a cam having a mounting surface connected to said gear mounting surface and rotated therewith, said cam having an engaging surface, opposed to said gear mounting surface, being engageable with said pawl to move said pawl to said second position; and a circuit connected to control said electromotive assembly operation;

wherein said second housing portion is interchangeably mountable with respect to said first housing portion in any one of several different mounting combinations of rotational orientation by having said cam is interchangeably mountable with respect to said gear in any one of several different mounting combinations of rotational orientation whereof said cam is mounted on said gear in one said orientation.

2. The latch of claim 1 , wherein said motor has an output shaft, wherein said pawl biasing includes a spring member biasing said pawl, wherein said gear is connected to said motor output shaft, and wherein said first housing portion holds said motor and said control circuit, and said second housing portion holds said pawl, said spring member, and said gear.

3. The latch of claim 2, wherein said pawl second position is an extended position, wherein said housing second portion mounting orientation to said housing first portion is selectable to provide for one of several different pawl extension directions, these pawl extension directions being oriented with respect to said housing first portion.

4. The latch of claim 3, wherein said several pawl extension directions include the right side direction, left side direction and the end of said housing direction.

5. The latch of claim 2, wherein said pawl second position is an extended position, wherein said housing second portion is selectively mountable in different orientations to said housing first portion to provide one of a plurality of pawl extension directions, said directions being oriented with respect to said housing first portion.

6. The latch of claim 5, wherein said plural pawl extension directions include at least two of the right side of said housing direction, left side of said housing direction and end of said housing direction.

7. An electromechanical latch assembly comprising:

a housing having a first and second portions;

a pawl for engaging a striker, wherein said pawl is movable within said housing second portion between an latch and an unlatch position;

an electrical motor and a circuit mounted in said first housing portion, said circuit controlling said electrical motor operation;

a connection between said electrical motor and said pawl enabling pawl movement by said electrical motor;

wherein said connection permits said second housing portion to be selectively reoriented with respect to said first housing portion to enable said pawl to operate in any one of alternate movement operating directions selected with respect to said electrical motor orientation;

wherein said connection includes a gear with a cam mounted thereon for cam rotation with said gear rotation, and wherein said pawl includes a cam follower cavity to which said cam is engageable, wherein the gear and cam are reorientable with respect to said cam engagement with the cam follower cavity depending upon the pawl operation direction selected.

8. The electromechanical latch of claim 7, also including:

a biasing member urging said pawl to an extended position with respect to said housing, wherein said gear has a hub, and wherein said cam is mounted on said gear hub and positioned to engage said pawl.

9. The electromechanical latch of claim 7, wherein said pawl is selectively reorientable to selectively extend in one of several directions.

10. An electromechanical latch assembly comprising:

a housing having a first and second portions;

a pawl for engaging a striker, wherein said pawl is movable within said second housing portion;

an electrical motive member, and a circuit controlling said electrical motive member operation, said electrical motive member and said circuit both being mounted to said first housing portion, said electrical motive member being an electrical motor having a shaft extension;

a connection between said electrical motive member and said pawl enabling pawl movement by said electrical motive member;

wherein said connection permits said second housing portion to be selectively reoriented with respect to said first housing portion to enable said pawl to operate in any one of alternate movement operating directions selected with respect to said electrical motive member orientation;

wherein said pawl is selectively reorientable to selectively extend in a direction selected from right hand, left hand and forward directions with respect to the motor shaft extension;

wherein said connection includes a gear with a cam mounted thereon for cam rotation with said gear rotation, and wherein said pawl includes a cam follower cavity to which said cam is engageable, wherein the gear and cam are reorientable with respect to said cam engagement with the cam follower cavity depending upon the pawl operation direction selected.

11. The latch assembly of claim 10, wherein said cam follower camming surface has a curved portion and a straight portion.

12. The latch assembly of claim 10, wherein said cam rotates in only one direction.

13. The latch assembly of claim 12, wherein said cam rotation is stopped after 180 degrees of rotation under said control circuit control of said electrical motive member.

14. The latch assembly of claim 13, wherein when said cam rotation is continued to 360 degrees of rotation, said pawl is free to move free of said cam and cam follower camming surface engagement.

* * * * *

UNITED STATES PATENT AND TRADEMARK OFFICE

CERTIFICATE OF CORRECTION

PATENT NO. : 7,731,250 B2
APPLICATION NO. : 12/116313
DATED : June 8, 2010
INVENTOR(S) : Gregory Gilbert Garneau et al.

It is certified that error appears in the above-identified patent and that said Letters Patent is hereby corrected as shown below:

Column 6, Line 13, replace "paw 49" with --pawl 49--;

Column 7, Line 29, replace "paw" with --pawl--;

Column 8, Claim 1, Lines 41-42, replace "having said cam is interchangeably" with --having said cam interchangeably--.

Signed and Sealed this

Third Day of August, 2010

David J. Kappos

David J. Kappos
*Director of the United States Patent and Trademark Office*